US006974638B2

(12) United States Patent
Stamm

(10) Patent No.: US 6,974,638 B2
(45) Date of Patent: Dec. 13, 2005

(54) PROTECTIVE COATING

(75) Inventor: Werner Stamm, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/754,949

(22) Filed: Jan. 9, 2004

(65) Prior Publication Data

US 2004/0170521 A1 Sep. 2, 2004

(30) Foreign Application Priority Data

Jan. 10, 2003 (WO) ..... PCT/EP03/00183

(51) Int. Cl.[7] ..... B32B 15/00
(52) U.S. Cl. ..... 428/678; 428/680; 420/437
(58) Field of Search ..... 428/678, 679, 428/980; 420/435, 436, 437, 438, 439, 440

(56) References Cited

U.S. PATENT DOCUMENTS 4,005,989 A 2/1977 Preston
4,034,142 A 7/1977 Hecht
5,154,885 A 10/1992 Czech et al.
5,268,238 A 12/1993 Czech et al.
5,273,712 A 12/1993 Czech et al.
5,401,307 A * 3/1995 Czech et al. ..... 106/14.05
5,599,385 A 2/1997 Czech et al.
6,346,134 B1 2/2002 Russo et al.

FOREIGN PATENT DOCUMENTS

DE 2 355 674 5/1974
JP 2003183754 * 7/2003

* cited by examiner

*Primary Examiner*—Jennifer McNeil

(57) ABSTRACT

Protective coatings known in the state of art can reveal either good corrosion resistance or good mechanical properties.

An inventive protective coating resistant to corrosion at medium and high temperatures essentially consisting of the following elements (in percent by weight): 26 to 30% nickel, 20 to 28% chromium, 8 to 12% aluminium, 0.1 to 3% of at least one reactive element of the rare earths, cobalt balanced, reveals good corrosion resistance combined with good mechanical properties.

9 Claims, 1 Drawing Sheet

PROTECTIVE COATING

CROSS REFERENCE TO RELATED APPLICATIONS

This application claims priority to the International application No. PCT/EP03/00183, filed Jan. 10, 2003 under the Patent Cooperation Treaty and which is incorporated by reference herein in its entirety.

FIELD OF INVENTION

The invention relates to a protective coating.

BACKGROUND OF INVENTION

Numerous compositions of protective coatings of alloys which primarily contain nickel, chromium, cobalt, aluminium and a reactive element of the rare earths have been developed and tested. Such coatings have become known heretofore from U.S. Pat. Nos 4,005,989, or 5,401,307 for example. From U.S. Pat. No. 4,034,142, it is also known that an additional constituent, silicon, can further improve the properties of such protective coatings.

Although the relatively wide ranges of the various elements in these documents, in fact, do suggest qualitatively a way to create protective coatings resistant to high-temperature corrosion, the compositions disclosed are not sufficiently specific quantitatively for all purposes.

German Patent 23 55 674 discloses further compositions for protective coatings, but they are not suitable for uses or applications of the type which can occur with stationary gas turbines having a high inlet temperature.

These protective coatings show a high degree of inner oxidation and therefore the development of cracks, which leads to an ablation of the above laying coating.

SUMMARY OF INVENTION

It is an object of the invention to provide a protective coating application applied on a component in which the development of cracks, which reduce the mechanical properties and adhesion of other above laying coatings, is at least reduced.

With the foregoing and other objects in view, there is provided in accordance with the invention, a protective coating resistant to corrosion at medium and high temperatures on a component formed of nickel-based or cobalt-based alloy, essentially consisting of the following elements (in percent by weight):

0.26 to 30% nickel,
20 to 28% chromium,
8 to 12% aluminium,
0.1% to 3% rhenium,
0.1 to 3% of at least one reactive element of the rare earths,
cobalt balanced
and impurities as well as selectively from 0 to 15% of at least one of the elements of the group consisting of rhenium, platinum, palladium, zirconium, manganese, tungsten, titanium, molybdenum, niobium, iron and hafnium.

The preferred range of molybdenum is 1.5 wt % to 2 wt %, of tungsten is 2.5 wt % to 4 wt %, of titanium is up to 1 wt %, of zirconium up to 0.1 wt %, of hafnium up to 1 wt % and of boron up to 0.5 wt %.

Also 0.08 wt % to 0.1 wt % carbon can be added.

The protective coating develops no brittle phases in the coating and in the interface between base material and coating. The oxidation resistance is improved. The amount and structure of the aluminium rich phase is high enough to develop a good anchoring layer: a TGO (thermally grown oxide) layer on top of the MCrAlY and between MCrAlY ceramic, respectively.

In this regard, the selective inclusion of a particular element of the last-mentioned group of elements is based upon knowledge that the element does not worsen the properties of protective coatings but, instead, actually improves them, at least under certain circumstances.

The following properties or significance can be ascribed to the various constituents of the protective coating:

Cobalt, as a constituent, effects good corrosion properties at high temperatures.

Nickel improves the ductility of the coating and reduces interdiffusion with respect to the nickel-based base materials. The preferred range of nickel is from 26 to 30% and preferably approximately 28%.

Chromium improves the corrosion properties at medium temperatures up to approximately 900° C. and promotes the formation of an aluminium oxide covering film. The preferred range for chromium is from 20 to 28% and in particular approximately 24%.

Aluminium improves the corrosion properties at high temperatures up to approximately 1150° C. The content of aluminium should be in the range from 8 to 12%, in particular, approximately 10%.

The effect of a reactive element, in particular yttrium, is known per se. The preferred range thereof is from 0.1 to 3% and, in particular, approximately 0.6%.

In the preferential ranges given, tests have shown particularly good corrosion properties of the protective coatings for applications in gas turbines having an inlet temperature above 1200° C.

From prior art literature, various elements have become known which do not impair the properties of a protective coating, but rather, in some aspects actually improve them when admixed in a range less than a total of 15%, and in particular in an amount of only a few percent. The invention of the instant application is also intended to encompass protective coatings with such admixtures.

An element which has scarcely been given any consideration for protective coatings, namely rhenium, can markedly improve the corrosion properties if it is admixed in an amount of 0.1 to 3%, preferably 0.1% to 2% or 0.1% to 1%.

Although rhenium is not as expensive as most noble metals, as a constituent of a protective coating it can produce properties just as good as those achieved, for example, by platinum, and can also be effective even when it constitutes only a small share of the protective coating. Therefore good results are yielded with a rhenium content from 1% to 2% preferably 1.2% to 1.7%.

The coatings according to the invention are applicable by plasma spraying or vapour deposition (PVD), and they are particularly well suited for gas turbine blades formed from a nickel-based or cobalt-based superalloy. Other gas-turbine components, as well, particularly in gas turbines having a high inlet temperature of above 1200° C., for example, may be provided with such protective coatings. The special composition of the coating according to the invention has proved in tests to be a particularly suitable selection for stationary gas turbines having a high inlet temperature. Such tests will be discussed in the following.

EXAMPLES

The components onto which the coatings as previously described are applied are advantageously manufactured from nickel-based or cobalt-based superalloys. The components may be formed from:

1. Forging alloys consisting essentially of (in percent by weight): 0.03 to 0.05% carbon, 18 to 19% chromium, 12 to 15% cobalt, 3 to 6% molybdenum, 1 to 1.5% tungsten, 2 to 2.5% aluminium, 3 to 5% titanium, optional minor additions of tantalum, niobium, boron and/or zirconium, balance nickel. Such alloys are known as Udimet 520 and Udimet 720.

2. Casting alloys consisting essentially of (in percent by weight): 0.1 to 0.15% carbon, 18 to 22% chromium, 18 to 9% cobalt, 0 to 2% tungsten, 0 to 4% molybdenum, 0 to 1.5% tantalum, 0 to 1% niobium, 1 to 3% aluminium, 2 to 4% titanium, 0 to 0.75% hafnium, optional minor additions of boron and/or zirconium, balance nickel. Alloys of this type are known as GTD 222, IN 939, IN 6203 and Udimet 500.

3. Casting alloys consisting essentially of (in percent by weight): 0.07 to 0.1% carbon, 12 to 16% chromium, 8 to 10% cobalt, 1.5 to 2% molybdenum, 2.5 to 4% tungsten, 1.5 to 5% tantalum, 0 to 1% niobium, 3 to 4% aluminium, 3.5 to 5% titanium, 0 to 0.1% zirconium, 0 to 1% hafnium, an optional minor addition of boron, balance nickel. Such alloys are known as PWA 1483 SX, IN 738 LC, GTD Ill, IN 792 CC and IN 792 DS; IN 738 LC is deemed to be particularly useful in the context of this invention.

4. Casting alloys consisting essentially of (in percent by weight): about 0.25% carbon, 24 to 30% chromium, 10 to 11% nickel, 7 to 8% tungsten, 0 to 4% tantalum, 0 to 0.3% aluminium, 0 to 0.3% titanium, 0 to 0.6% zirconium, an optional minor addition of boron, balance cobalt.

It is particularly advantageous to apply coatings having a thickness in the range of 200 $\mu$m to 300 $\mu$m.

Tests

Cyclic oxidation tests have been performed. The test cycle was 1000° C., 2 hours, 15 min. cooling down by compressed air. In the test the new coating composition shows a superior cyclic oxidation behaviour. The time to spoliation was about 2.5 times longer than other coatings tested in the same kind of test.

BRIEF DESCRIPTION OF THE DRAWING

The FIGURE is a bar graph showing comparative test results of various coatings.

DETAILED DESCRIPTION OF THE DRAWING

Figure 1:
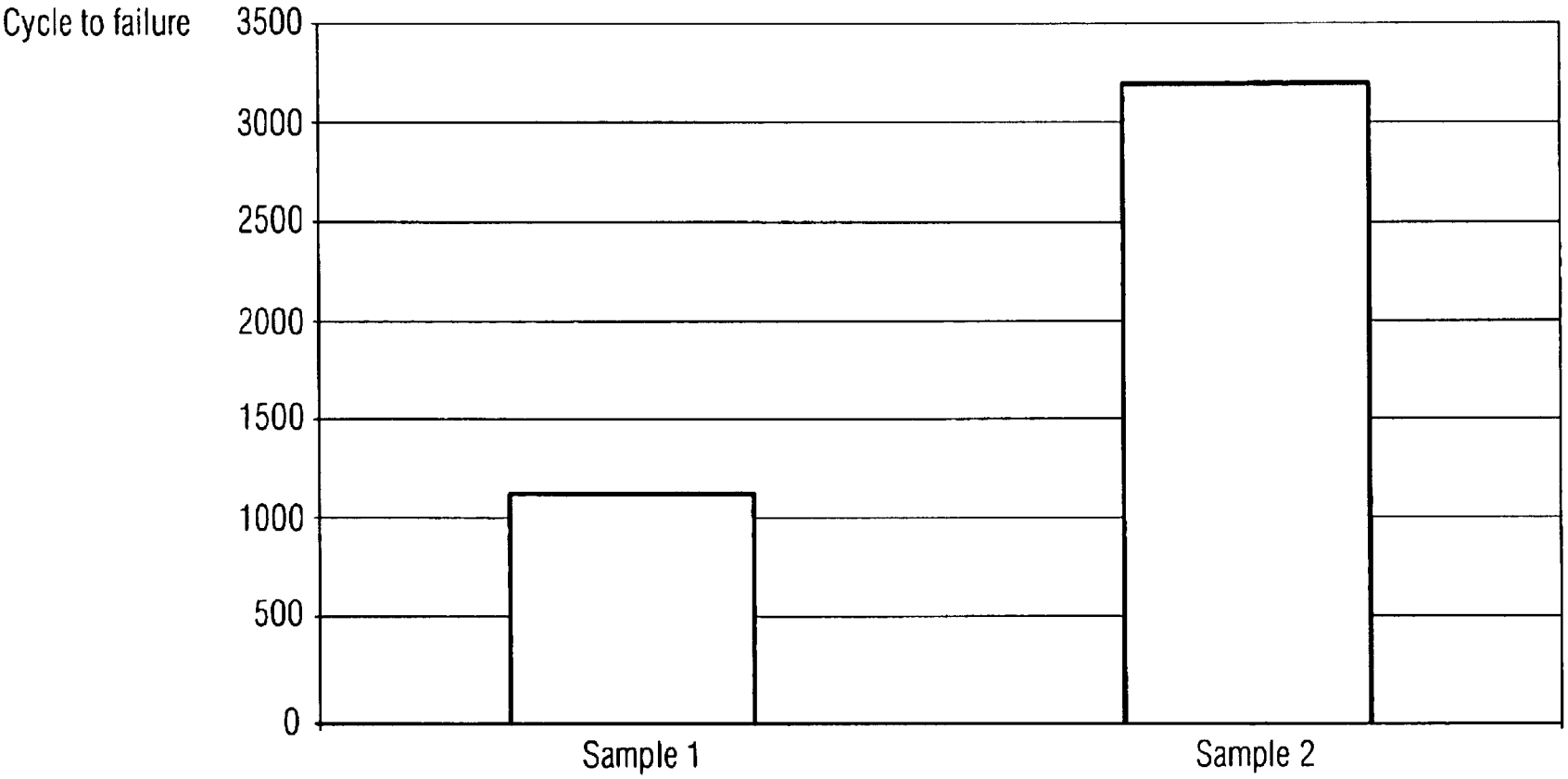

With reference to the graph of the FIGURE, which illustrates the test results, sample 1 is a prior art coating as it is widely used whereas sample 2 is according to the present invention.

With regard to the above classification, samples 1 and 2 had a base material made from PWA1483SX.

As compared to prior art sample 1 (11% to 13% Co, 20% to 22% Cr, 10.5% to 11.5% Al, 0.3% to 0.5% Y, 1.5% to 2.5% Re, Ni balance, known from U.S. Pat. Nos 5,154,885, 5,273,712 or 5,268,238) the inventive sample 2 (present invention in wt %: 28% Ni, 24% Cr, 0.6% Y, 10% Al, Co balanced) is clearly advantageous particularly in terms of their cyclic oxidation behaviour.

As shown in the graph, the prior art sample 1 exhibit a cycle to failure number of about 1200 cycles. The sample produced according to the invention exhibit a cycle to failure number of about 3200 cycles.

Sample 1 has been widely considered the best coating known in the pertinent art, especially in terms of its cyclic oxidation resistance.

Coatings according to the present invention make it no longer necessary to compromise between oxidation resistance and ductility (important for tear resistance and adhesion). These properties are not only optimised relative to each other, but they are vastly improved over the prior art.

We claim:

1. A protective coating resistant to oxidation applied on a nickel-based or cobalt-based superalloy component, the protective coating comprising the following elements (in percent by weight):

26% to 30% nickel;

20% to 28% chromium;

0.1% to 3% rare earth element;

0.08% to 0.1% carbon;

8% to 12% aluminium; and

0% to 45% cobalt.

2. The protective coating according to claim 1, wherein 0.1 wt % to 3 wt % rhenium is added.

3. The protective coating according to claim 1, wherein 1.5 wt % to 2 wt % molybdenum is added.

4. The protective coating according to claim 1, wherein 2.5 wt % to 4 wt % tungsten is added.

5. The protective coating according to claim 1, wherein the coating comprises (in percent by weight):

0 to 1% titanium, 0 to 0.1% zirconium, 0 to 1% hafnium, 0 to 0.5% boron is added.

6. The protective coating according to claim 1, wherein the elements of the group consisting of rhenium, platinum, palladium, zirconium, manganese, tungsten, titanium, molybdenum, niobium, iron and hafnium are admixed in a total amount less than 15 wt %.

7. The protective coating according to claim 1, wherein 1.5 wt % to 4.5 wt % tantalum is added.

8. The protective coating according to claim 1, wherein (in percent by weight):

about 28% nickel, about 24% chromium, about 10% aluminium, 0.1% to 3% rare earth element, and balance cobalt.

9. The protective coating according to claim 8 wherein (in percent by weight):

about 0.1% to 3% rhenium is added.

* * * * *